United States Patent [19]

Showalter

[11] 4,056,169

[45] Nov. 1, 1977

[54] ELEVATOR CONTROL SYSTEM

[75] Inventor: John Melville Showalter, Clark, N.J.

[73] Assignee: United Technologies Corporation, Hartford, Conn.

[21] Appl. No.: 700,630

[22] Filed: June 28, 1976

[51] Int. Cl.[2] ..... B66B 5/02

[52] U.S. Cl. ..... 187/29 R

[58] Field of Search ..... 187/29

[56] References Cited

U.S. PATENT DOCUMENTS

| | | | |
|---|---|---|---|
| 3,791,490 | 2/1974 | Smith | 187/29 |
| 3,792,759 | 2/1974 | Kirsch | 187/29 |
| 3,815,710 | 6/1974 | Shrum | 187/29 |
| 3,896,906 | 7/1975 | Shrum | 187/29 |
| 4,011,928 | 3/1977 | Spear et al. | 187/29 |

*Primary Examiner*—Robert K. Schaefer
*Assistant Examiner*—W. E. Duncanson, Jr.
*Attorney, Agent, or Firm*—Robert T. Mayer

[57] ABSTRACT

An elevator control system for use in a building which may vibrate due to wind gusts. The system operates to reduce the maximum velocity which an elevator car can attain when a vibration sensing means indicates that the building has been vibrating at a predetermined magnitude for a predetermined time interval.

18 Claims, 6 Drawing Figures

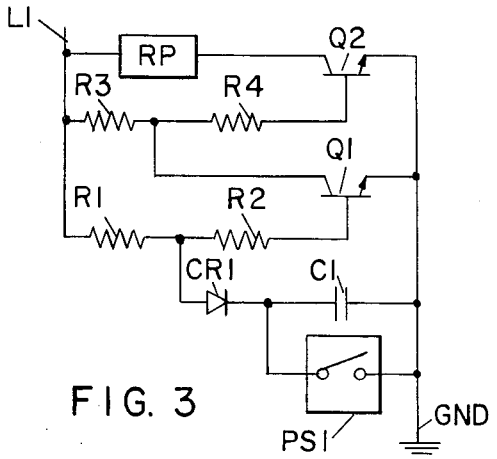
FIG. 3
FIG. 4
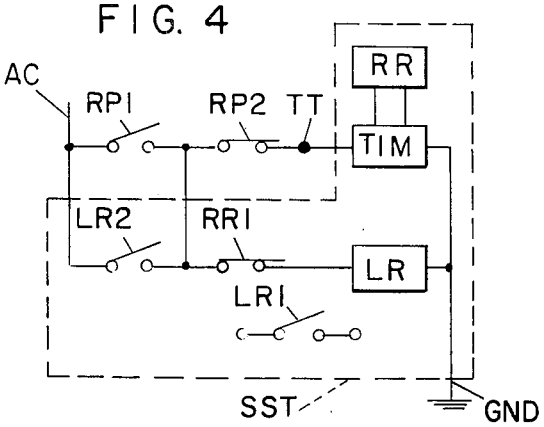
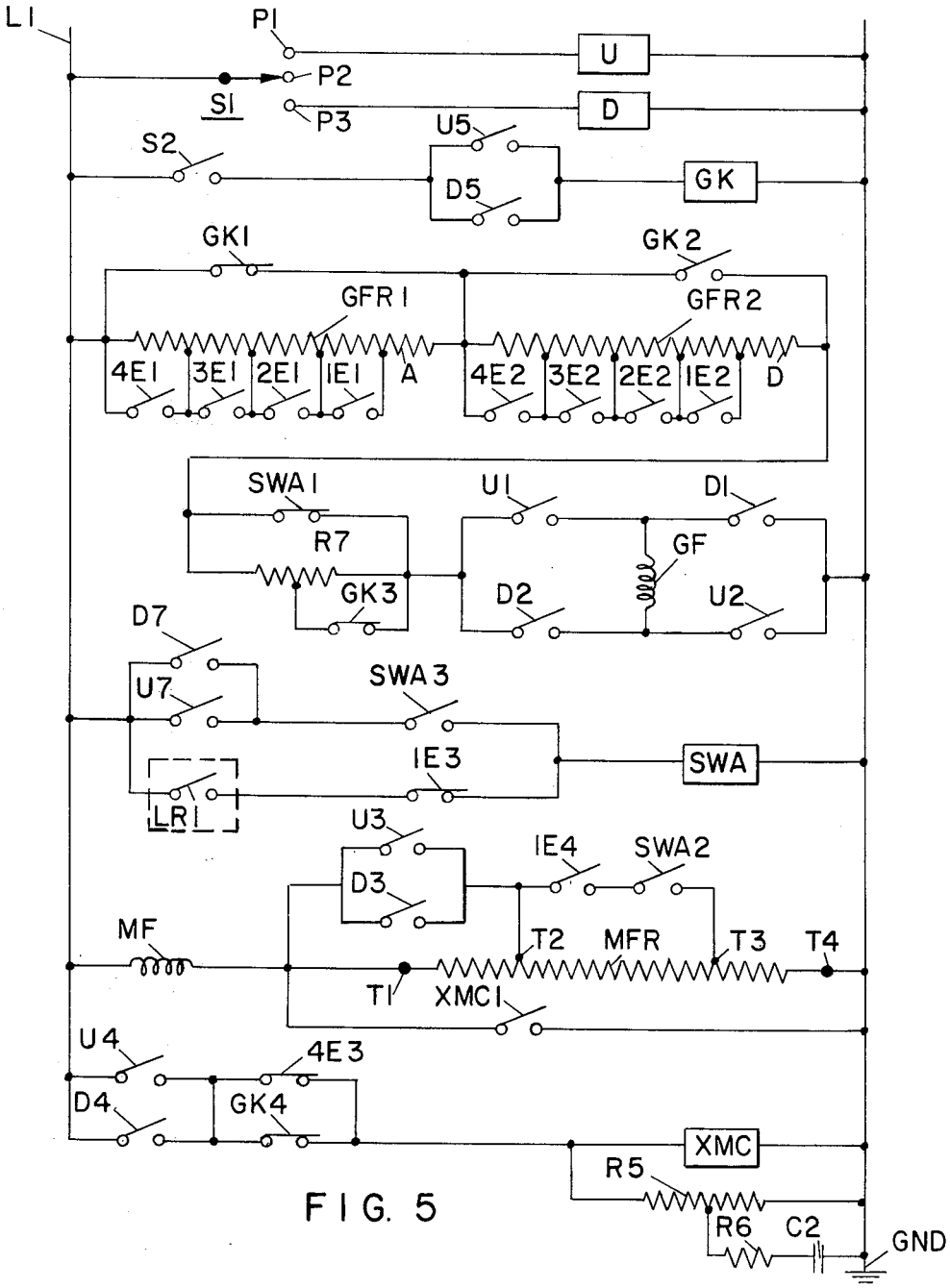
FIG. 5

ELEVATOR CONTROL SYSTEM

This invention relates to elevator control systems. More particularly, it concerns arrangements for modifying elevator operation when the building in which the elevator is located is vibrating in response to an external wind load.

In the past, buildings were built with a higher ratio of concrete to steel than at present. These older buildings do not tend to sway or vibrate in response to high gusts of wind in the same way as more modern buildings because the concrete acts as a vibration damper. Modern high-rise buildings constructed with curtain walls, with their lower concrete to steel ratio tend to respond like a flexible cantilever. Each sways or vibrates in response to a wind load at a relatively fixed period.

This vibrating of modern high rise buildings is troublesome since it can cause swaying of the elevator hoisting cables which support each car and its counterweight, as well as the compensating cables which are suspended under the elevator car and its counterweight in some installations. Both the hoisting and compensating cables typically comprise a number of closely spaced individual cables and such swaying can cause these individual cables to tangle with one another. Cable damage can result from such cables travelling around their drive sheave or compensating sheave in an entangled condition. This problem can be so severe with respect to the compensating cables in an installation that it can cause severing of those cables.

In the past it was found that reducing the maximum speed of an elevator car could reduce the chances of building sway causing damage to elevator hoisting and compensating cables. Operating the car at a slower speed is thought to provide additional time for the cables to untangle before travelling around their respective sheaves. It is also thought that the swaying of the elevator cables decreases directly with reduction in elevator speed. In accordance with these ideas, some elevators in modern high-rise buildings have been provided with manual speed selection switches. These enable attendants to select either the rated speeds or reduced ones as the maximum speeds at which the associated elevator can operate. Such arrangements rely upon the judgment and diligence of the attendants. These individuals must observe wind conditions and decide to select reduced speed in accordance with whether the wind conditions are such that they think elevator cable damage is likely to occur if the elevators operate at their rated speeds.

Known systems have been designed to prevent damage to the elevator system when seismic shocks cause building vibrations of a magnitude sufficient to derail the counterweight. Some of these systems have mounted on the counterweight a ring which makes electrical contact with a vertically suspended cable when the counterweight is derailed. This electrical contact is associated with the elevator control apparatus to prevent car movement toward the counterweight when operated.

Other systems have included commercially available seismic detectors consisting of a plumb bob suspended in a ring to produce a signal in response to large seismic shocks developed during an earthquake. These latter systems also operate upon the elevator control apparatus to prevent cars movement toward the counterweight. All of these systems are designed to respond to large seismic shock and are insensitive to the relatively small forces of vibration caused by wind load.

It is an object of this invention to provide an improved elevator control system.

A further object of this invention is to provide an elevator system which reduces the possibility of damage to elevator cables caused by swaying of the cables.

It is another object of this invention to provide an elevator control system which in response to building vibrations caused by wind automatically reduces the maximum speed at which its elevator car can operate.

In the presently preferred embodiment, a pendulum-like device hereinafter called a pendulum is suspended from the top of an elevator hoistway in a building to respond to the building's vibrations caused by wind. The free length of this pendulum determines its sensitivity to such vibrations. If the length is chosen so that the period of this pendulum, as determined in accordance with the theory of pendulum movement, is the same as the previously mentioned period at which the building vibrates in response to wind, then this pendulum provides maximum sensitivity to such vibrations. Sensitivity is adjustable by changing the free length. In adjusting the sensitivity, the peculiarities of the particular installation is taken into account as is the time required for vibrations to build up in this pendulum. The sensitivity affects how rapidly this pendulum reaches a given amplitude of swing in response to building vibration of a predetermined magnitude being sustained for a predetermined time interval.

In the preferred embodiment, a weight is suspended by cable from the top of the hoistway to form this pendulum. A ring is mounted in the elevator hoistway and encircles the weight. When the amplitude of the pendulum's movement exceeds a predetermined amplitude it makes contact with this ring. This contact closes an electrical circuit to a limit means which operates together with a speed control means to limit the maximum velocity which the elevator car can attain during an interfloor trip to a velocity below the cars' rated velocity.

One feature of the preferred embodiment is that its pendulum is arranged to have an adjustable free length by utilizing an upper support means and a clamping means. The upper support means is such that if only it were used, the free length of this pendulum would be set to provide maximum sensitivity. Detachably affixed below the upper support is the clamping means whose position is vertically adjustable. The clamping means can reduce the free length and thus renders the sensitivity of the pendulum adjustable.

According to another feature of the preferred embodiment, a low speed signifying means is included so that the limit means cannot operate to limit maximum attainable velocity if the car is already travelling in excess of a predetermined velocity. This feature prevents a speed reduction in the middle of a trip so that passengers are not subjected to an unexpected deceleration.

According to another feature of the preferred embodiment, the low speed signifying means is arranged so that the limit means cannot operate to enable the speed control means to permit rated velocity if the car has started on a limited velocity trip and has attained or exceeded a particular velocity during that trip. This feature prevents passengers from being subjected to unexpected acceleration.

The signal produced by the pendulum of the presently preferred embodiment can be intermittent. Vibrational forces might be such that the weight might only briefly contact the ring within which it is suspended and consequently inherently produce a signal having a short duration. Furthermore, the wind load may unexpectedly disappear for brief intervals on windy days causing the amplitude of the pendulum oscillations to decay for short periods to below the predetermined amplitude needed for the weight to contact the ring.

Another feature of the invention is that a stabilizing means is included to convert such intermittent signals produced by the pendulum into a signal which is maintained for a minimum predetermined time interval.

According to a further feature of the preferred embodiment, the pendulum cable is suspended from a mechanical pivot to reduce flexing and abrasion of the cable. This pivot comprises a first member suspended from a bracket and a second member suspended from the first. These two members are free to pivot in different vertical orthogonal planes so that the cable can move through 360° without flexing.

In accordance with the present invention, an elevator control system is provided for use in a building which occasionally experiences vibration caused by wind. The elevator control system includes a drive motor for moving an elevator car through a hoistway to any one of a plurality of landings at which it can be stopped. The control system includes a speed control means for controlling the motor so that it can move the car at a maximum velocity having a first predetermined magnitude. The elevator control system also includes vibration sensing means responsive to vibratory motion and producing a vibration signal in response to vibratory motion of a predetermined magnitude being sustained for a predetermined time interval. Also included is a limit means operating in response to the vibration signal and controlling the speed control means to limit the maximum velocity at which the motor can move the car to a second predetermined magnitude which is less than the first predetermined magnitude.

Other objects and features of the invention will be apparent from the foregoing and the following description when considered in conjunction with the appended claims and the accompanying drawing in which:

FIGS. 3 and 4 are simplified wiring diagrams of part of the presently preferred elevator control system of the present invention; and FIG. 5 is a simplified wiring diagram of another part of the presently preferred elevator control system including portions of the speed control circuit thereof.

Figure 1:
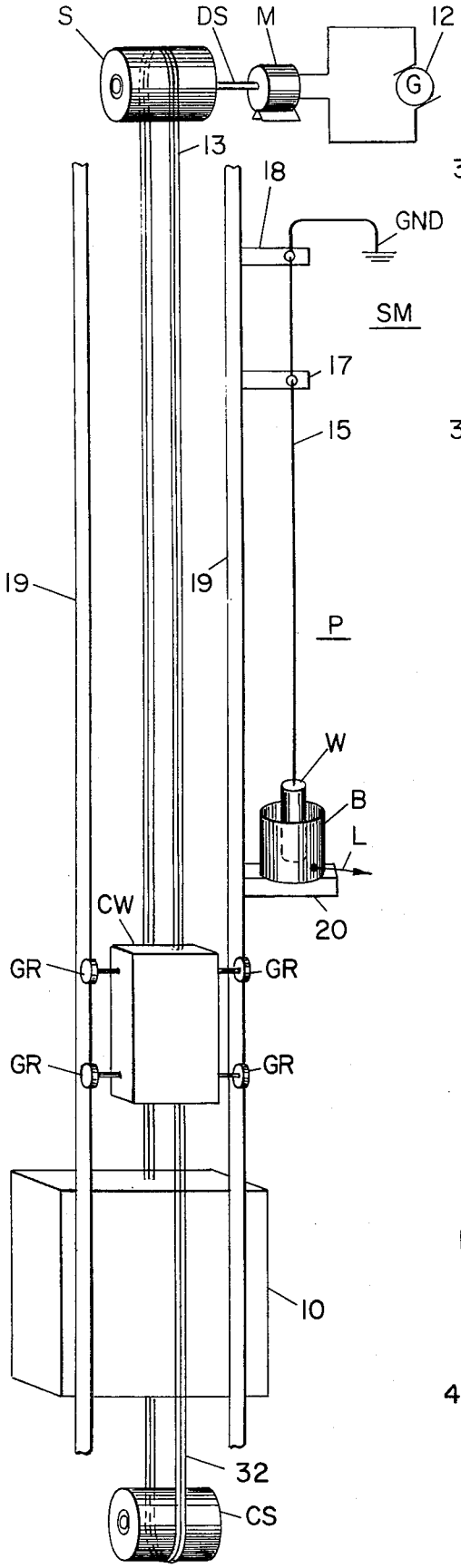
FIG. 1 is a simplified representation of parts of an elevator installation including an elevator car and a portion of its hoistway together with a vibration sensing means.

The following list indicates names of electromagnetic switches shown in the drawing. Listed adjacent these names are reference characters utilized throughout the specification and in the drawing to identify the actuating coils of the respective switches. Numerical suffixes are also appended to these reference characters in both the specification and drawing to identify the contacts of the respective switches:

| | |
|---|---|
| D | Down Direction Switch |
| 1E | First Speed Switch |
| 2E | Second Speed Switch |
| 3E | Third Speed Switch |
| 4E | Fourth Speed Switch |
| GK | Stop Control Switch |
| LR | Latched Pendulum Switch |
| RP | Pendulum Slave Switch |
| RR | Timer Reset Switch |
| SWA | Sway Control Switch |
| U | Up Direction Switch |
| XMC | Motor Field Switch |

It is noted that the coils associated with the four speed switches do not appear in the drawing; only the associated contacts are illustrated. Electro-magnetic switches are shown in the de-energized state.

Resistors, capacitors and rectifiers are identified in the drawing by the reference characters R, C, and CR respectively. Appropriate suffix numerals are appended to these characters to differentiate one such element from another of the same type.

It is to be understood that to facilitate the disclosure of the invention it is illustrated in a system which is much simpler than would be found in a commercial installation.

Referring to FIG. 1, a general arrangement is shown which includes a generator G and motor M combination of the well-known Ward Leonard type. The motor M being on common shaft DS with sheave S drives the elevator car 10 and counterweight CW by means of a hoist cables 13. Counterweight CW is guided by the interaction of rails 19 with guide rollers GR. Compensating cables 32 are suspended from the car 10 and counterweight CW and routed around a compensating sheave CS for counterbalancing the weight of drive cables 13. Sheave CS is mounted in the hoistway pit (not shown) in any suitable well-known manner.

A pendulum P comprising cable 15 and a weight W is suspended from support SM. Support SM includes a clamping means 17 and an upper support means 18. Clamping means 17 is mounted in the hoistway at a height at which vibratory motion of a predetermined magnitude occurs. Clamping means 17 is suitably attached to one of the counterweight rails 19 in the elevator hoistway near the top thereof and is vertically adjustable to facilitate changing the length of the free cable below clamping means 17. Suitably fastened to rail 19 above clamping means 17 is upper support means 18 to which the restrained end of cable 15 is secured. Located properly below pendulum P so as to have weight W extending partly thereinto is bucket B which is suitably fastened to rail 19 by electrically insulating support 20. This pendulum P is included in an electrical circuit which can extend from ground GND through upper support 18, cable 15, weight W, and bucket B to wire L. This electrical circuit and the components forming it comprise a vibration sensing means which provides a vibration signal in response to vibratory motion of the building of a predetermined magnitude being sustained for a predetermined time interval. Cable 15 freely suspends weight W from clamping means 17, cable 15 having a free length between clamping means 17 and weight W such that weight W moves a predetermined distance from an equilibrium position in response to the above mentioned vibratory motion.

As mentioned previously buildings in which the present invention is desirably utilized vibrate at a relatively fixed predetermined period. This period of each building is used to determine the free length of cable 15 between clamping means 17 and weight W to be provided in each associated building. Suitably, each cable 15 has a free length as so measured which if possessed by a true pendulum would provide it with a period of free vibration which differs from the above mentioned predetermined associated building period by a predetermined amount. When each cable 15 is released from its clamping means 17 its upper support means 18 suitably provides each with a free length which if possessed by a true pendulum would provide it with a period of free vibration substantially equal to the fixed predetermined period of the building in which each particular embodiment of the invention is installed.

The top circular edge of bucket B forms an electrically conductive annular member vertically aligned with clamping means 17 and horizontally mounted in the hoistway at a height to encircle weight W which thereby make contact therewith upon moving the predetermined distance from the equilibrium position in response to vibrating motion.

Figure 2:
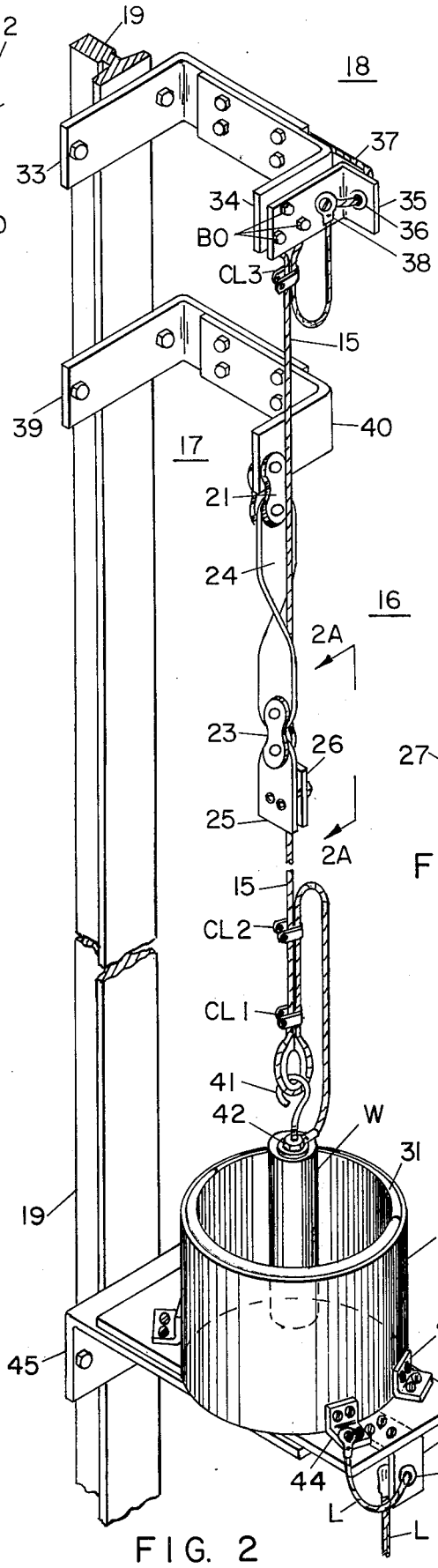
FIG. 2 is a preferred embodiment of the vibration sensing means of the present invention.
Figure 2A:
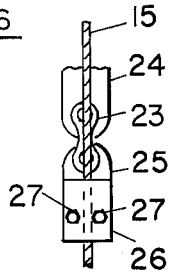
FIG. 2A is a view of details of the vibration sensing means of FIG. 2 taken along lines 2A—2A.

Referring to FIG. 2, a more detailed representation of pendulum P of FIG. 1, as arranged in the disclosed preferred embodiment, is shown. Electrically conductive cable 15 is suitably fastened to upper support 18 by means of clamping bracket 35. The upper support comprises a pair of brackets 33 and 34 which are suitably fastened together, bracket 33 being fastened directly to counterweight rail 19 with suitable rail clips (not shown). Clamping bracket 35 also supports a feed-through 36 which provides an electrical connection from wire 37 to terminal point 38. Terminal point 38 is electrically connected to clamping bracket 35 and cable 15. Clip CL3 forms cable 15 into a loop which surrounds the bolts BO which fasten clamping bracket 35 to bracket 34.

Clamping means 17 includes a pair of brackets 39 and 40 which are bolted together and detachably affixed to rail 19 by suitable rail clips (not shown). Suspended from bracket 40 is a roller chain link 22, member 24, roller chain link 23 and member 25. Roller chain links 22, 23 are available commercially and members 24 and 25 are steel plates; member 24 having a 90° twist in it. Links 22 and 23 pivotally support members 24 and 25 so that each can angularly translate in different ones of a pair of vertically disposed orthogonal planes. The brackets 39 and 40 together with members 24 and 25 and roller chain links 23 and 24 are that part of the clamping means known as the intermediate support means. Cable 15 is suspended from member 25 by a clamping device 26 which compresses cable 15 between itself and member 25 when bolts and nuts 27 are tightened sufficiently. This arrangement provides two degrees of freedom so that pendulum P can oscillate in any direction through 360°. The arrangement also permits the tension in cable 15 above member 25 to be reduced and reduces the flexing and abrading of cable 15.

On the lower end of cable 15, weight W is suspended from a loop in the cable which is formed in it by clips CL1, CL2. In the constructed embodiment, weight W was a ten inch length of two inch pipe which was lead filled. Cable 15 is brought through clips CL1, CL2 to connection point 42 on weight W to assure electrical continuity from the top of the cable to the weight W.

Bucket B comprises a twelve inch diameter toroidal ring 31 welded to the top of a metal cylinder. Conductor L is connected through feed-through 50 to metal bracket 44, thereby providing electrical continuity from ring 31. As stated earlier bucket B is supported from rail 19 by an insulating support 20 which prevents it from being grounded. Bracket 45 is fastened to rail 19 by suitable rail clips (not shown) to provide support for insulating support 20. In the preferred embodiment bucket B has a perforated bottom which allows water which otherwise could collect in the bucket to drain off but can catch the weight W should cable 15 break.

Referring to FIG. 3, electrical contacts PS1 are shown schematically to represent the electrical circuit from ground GND to line L (FIG. 1) which is completed and interrupted when weight W comes into contact with and separates from toroidal ring 31 of bucket B of FIG. 2. The movable contact of contacts PS1 represents weight W and cable 15 and the stationary contact represents bucket B. Contacts PS1 are shown connected across capacitor C1 which is connected in series circuit with the cathode of rectifier CR1. The anode of that rectifier is connected to the junction formed by one terminal of each of resistors R1 and R2. The other terminal of resistor R1 is connected to line L1 and the other terminal of resistor R2 to the base of transistor Q1. The emitter of this transistor is connected to ground GND and the collector to the junction formed by one terminal of each of resistors R3 and R4. The other terminal of resistor R3 is connected to line L1 and the other terminal of resistor R4 to the base of transistor Q2. The emitter of this transistor is connected to ground GND and the collector to one terminal of coil RP of the pendulum slave switch. The other terminal of this coil is connected to line L1.

Sufficient voltage is applied across line L1 to ground to enable the electrical components connected therebetween as shown in FIGS. 3 and 5 to operate in the intended manner. As a consequence, the forementioned components shown in FIG. 3 serve as an amplifying circuit to cause the energization of coil RP upon weight W contacting bucket B as represented by the closing of contacts PS1.

Referring to FIG. 4, the elements enclosed in the dotted section are part of a stabilizing means which operates in response to vibratory motion of a predetermined magnitude being sustained for a predetermined time interval to produce a vibration signal for a given time period notwithstanding vibratory motion of the building should become less than the predetermined magnitude during that period.

In the constructed embodiment this stabilizing means comprised commercially available components sold by Industrial Solid State Controls as its Model #PBU1018J1. The timer TIM is connected to enable it to receive an alternating current electrical signal from line AC through contacts RP2 and LR2 to terminal TT. Such a signal if applied to a predetermined time interval causes timer TIM to produce a signal to energize coil RR. Removal of the alternating current electrical signal from terminal TT deenergizes coil RR, if energized. Such removal of the signal from terminal TT also resets timer TIM so that the predetermined time interval mentioned above is determined from the time the signal on terminal TT is restored.

Contacts RP1 and LR2 are connected in parallel, with one terminal of each being connected to line AC and the remaining terminals of each being connected to one terminal each of contacts RP2 and RR1. The remaining terminals of contacts RP2 and RR1 are connected to terminal TT and one terminal of coil LR, respectively.

Referring to FIG. 5, a group of switches are shown which are part of the elevator control system in which the constructed embodiment was installed. In addition the generator and motor field GF and MF respectively of the system are shown.

Switch S1 is a three-position switch which for purposes of simplification represents that apparatus of the constructed elevator control system in which the invention was installed which operates in response to the registration of car and hall calls to generate signals to start and stop the car. Coil U of an up direction switch is connected between terminal P1 of switch S1 and ground GND. Coil D of a down direction switch is connected between terminal P3 of switch S1 and ground GND, with the remaining terminal having no connection.

Switch S2 has a movable contact which operates in response to the generation of a stop signal. It is understood that for purposes of simplification switch S2 represents well-known selector apparatus of the disclosed constructed elevator system. Switch S2 will be actuated to the open position when the car is located a predetermined stopping distance from a landing at which a stop is to be made. This predetermined distance is chosen to correspond to the position at which a stopping operation should commence. Switch S2 will be closed when car 10 is accelerating away from the landing at which a stop was last made and while car 10 is travelling until it arrives at a predetermined stopping distance. Parallel contacts U5 and D5 are in series with coil GK of the stop control switch and switch S2 to deenergize coil GK if neither coil U nor D are energized.

Also shown is a pair of generator field resistance elements GFR1, GFR2. These resistance elements are in series with the generator field GF and are alternatively selected by the stop control switch (coil GK) to provide different series resistance for generator field GF. In addition, the speed switch contacts 1E1–4E1 and 1E2–4E2 are shown connected in parallel with various sections of these series resistance elements GFR1, GFR2 to enable their effective resistance to be changed. The manner of operation of the speed switches is well-known and a typical example of this operation can be found in U.S. Pat. No. 3,536,969. These speed switches are part of the speed control means of the invention which controls motor M so that it can move car 10 at a maximum velocity having a first predetermined magnitude.

Also shown in series with generator field GF is a resistance element R7. Resistance element R7 together with contacts SWA1 and GK3 comprise that part of the limit means of the invention which operates in response to the vibration signal and controls the speed control means to limit the maximum velocity at which motor M can move car 10 to a second predetermined magnitude which is less than the first predetermined magnitude.

In addition, contacts SWA1 are part of a first switching means which operates in response to the vibration signal and which connects resistance element R7 in series with the source of generator field potential on line L1 and generator field winding GF to limit the current applied thereto and thereby limit the maximum velocity at which motor M can move the car to the above-mentioned second predetermined magnitude.

Contacts 1E3 of the speed control means are connected in series with contacts LR1 of the latched pendulum switch and coil SWA of the sway control switch. Contacts 1E3 and LR1 are part of a first coupling means coupling the source of energizing potential on line L1 to a terminal of coil SWA in response to the production of the vibration signal when motor M is moving car 10 at a velocity less than the above-mentioned second predetermined magnitude. Contacts SWA3 and the parallel combination of contacts U7 and D7 are in series circuit and serially connected to coil SWA which is a relay means. The three last mentioned contacts are part of a second coupling means which operates in response to coil SWA being in its actuated condition and which couples the source of energizing potential on line L1 to a terminal of coil SWA as long as motor M is moving the car. The above-mentioned relay means and first and second coupling means are part of a low speed signifying means which is transferable from a first to a second state in response to the generation of a vibration signal when motor M is moving car 10 at a velocity less than the above-mentioned second predetermined magnitude. When in the second state the low speed signifying means controls the above-mentioned speed control means to limit the maximum velocity at which motor M can move car 10 to the above-mentioned second predetermined magnitude. The actuated and unactuated conditions of the sway control switch (coil SWA) correspond to the second and first states, respectively of the low speed signifying means.

Motor field MF is in series with resistance element MFR whose effective resistance can be changed by contacts U3, D3 and XMC1 which upon closing short sections of resistance element MFR. Contacts 1E4 and SWA2 are also connected to this variable resistance element MFR to form part of a second switching means which operates in response to the vibration signal to reduce the effective resistance of this variable resistance element MFR.

Parallel contacts U4 and D4 are in series circuit with parallel contacts 4E3 and GK4. Coil XMC is serially connected with parallel contacts 4E3 and GK4 and is connected in parallel with resistor R5. The series circuit formed of resistor R6 and capacitor C2 is connected between a tap on resistor R6 and ground GND.

In order to facilitate an understanding of the invention, the operation of the preferred embodiment will be first described under conditions in which weight W of pendulum P hasn't contacted bucket B and accordingly pendulum switch contacts PS1 (FIG. 3) are open. Under these conditions capacitor C1 (FIG. 3) is fully charged through rectifier CR1 to a voltage determined by resistors R1 and R2. Also, transistor Q1 (FIG. 3) is in its conductive state as a result of the current suppied to its base through resistors R1 nd R2. Accordingly, the collector of transistor Q1 as well as the junction of resistors R3 and R4 are approximately at the potential of ground GND. Therefore, the voltage across the base emitter junction of transistor Q2 (FIG. 3) is approximately zero volts so that current does not flow into the collector of transistor Q2. As a result coil RP (FIG. 3) is not energized and the pendulum slave switch is in its unoperated condition so that contacts RP1 (FIG. 4) are open and contacts RP2 (FIG. 4) are closed.

Assume coil LR of the latched pendulum switch is not energized and contacts LR2 are open. As a consequence no voltage is applied across terminal TT and ground GND and timer TIM is not actuated. Because coil LR is not energized, contacts LR1 (FIG. 5) are open and coil SWA is not energized through the current path which includes contacts LR1. Furthermore, assume that car 10 is at rest and contacts U7 and D7 are also open. Consequently, no current is flowing to coil SWA from line L1 through either of those contacts and the sway control switch is released. All other switches are also in their released condition.

Assume now that a signal to start upwardly is generated. This moves the movable contact of switch S1 (FIG. 5) from terminal P2 to terminal P1 thereby energizing coil U and actuating the up direction switch. At the same time switch S2 closes in response to the start signal so that coil GK is energized through that switch and now closed contacts U5. As a result contacts GK2 of the stop control switch are closed, shorting out resistance element GFR2. Current is thus provided to the generator field GF through a circuit path including resistance element GFR1 and closed contacts GK2, SWA1, U1 and U2. Contacts U1, U2 control current flow through generator field GF in the direction appropriate for producing current flow from generator armature 12 (FIG. 1) through motor M which results in it rotating to cause upward motion of car 10. Since none of the speed switches are operated yet the total resistance of element GFR2 is in series with generator field GF (FIG. 5). By controlling the magnitude of this series resistance the current in generator field GF is controlled as is consequently the speed of motor M.

The operation of the up direction switch also energizes coil XMC of the motor field switch through closed contacts U4 and 4E3. This causes the entire potential across lines L1 and ground GND to be applied across motor field MF by means of closed contacts XMC1. As a result a relatively large amount of current flows through the motor field so that motor M starts with a high torque.

As car 10 continues to move upwardly, sufficient time will elapse for the speed switches to operate sequentially until all four are operated and have closed their contacts 1E1, 2E1, 3E1 and 4E1. As is known, this causes full excitation of generator field GF and maximum output current from generator armature 12 (FIG. 1). When the fourth speed switch operates, contacts 4E3 (FIG. 5) open and since contacts GK4 are also open, coil XMC is deenergized. The resulting release of the motor field switch opens contacts XMC1 and permits current to flow through contacts U3 and a portion of resistance element MFR to ground GND. The series resistance presented by this portion of resistance element MFR reduces the current through motor field MF. As is well-known, reduction of the motor field current operates to increase the speed of motor M which thereafter continues to move car 10 upwardly at its rated speed.

Upward movement of the car 10 at rated speed continues until it arrives at a position stopping distance away from a landing at which a stop is to be made. Upon this occurrence a signal to stop is generated in a well-known manner and switch S2 opens to initiate the deceleration of the car 10. Accordingly, coil GK of the stop control switch is deenergized and the switch releases, causing contacts GK2 to open and contacts GK1 to close. Therefore, resistance element GFR2 is substituted for resistance GFR1 for insertion in the energizing circuit for generator field GF during deceleration. Moreover in this disclosed constructed embodiment portion D of resistance element GFR2 which is immediately inserted in series with generator field GF has a larger resistance value than portion A of resistance element GFR1 which had been in series with the field. As a result the energization of the field is reduced and the current supplied to motor M by generator armature 12 (FIG. 1) is also reduced. This provides the first step of motor deceleration.

The release of the stop control switch also closes contacts GK4 (FIG. 5) causing the energization of coil XMC of the motor field switch which operates to close contacts XMC1. This removes the resistance in series with motor field MF and consequently increases the current in the field. As is well-known the motor speed decreases providing another step of deceleration.

In a well-known manner the speed switches sequentially open contacts 4E2, 3E2, 2E2 and 1E2 as car 10 moves closer to the landing at which it is stopping. This increases the resistance in series with generator field GF in discrete steps, corresponding to further steps of deceleration of car 10. By the time all of the contacts 1E1 through 4E1 are open the car 10 is near the landing at which the stop is to be made. When the car moves into register with the landing at which the stop is to be made, the movable contact of switch S1 is moved from terminal P1 to terminal P2 deenergizing coil U and releasing the up direction switch. This causes contacts U1 and U2 to open interrupting the circuit of generator field GF.

As a result the output current from generator armature 12 (FIG. 1) ceases and motor M is no longer provided with current. Consequently it can no longer produce torque and simultaneously the brake (not shown) is applied in a well-known manner to maintain car 10 at the landing. With the release of the up direction switch contacts U4 (FIG. 5) open causing coil XMC to be deenergized whereby the motor field switch is released causing contacts XMC1 to open. This places motor field MF in series with the total resistance of resistance element MFR, reducing the motor field excitation to a minimum.

The foregoing describes the elevator operation under a condition where the contacts PS1 (FIG. 3) are open. This corresponds to a situation where the building is not vibrating due to wind. The subsequent description will describe the control of the elevator under a situation where the building is experiencing vibration which causes the closing of contacts PS1. In order to fully describe the conditions which cause this closure, the nature of the vibration of the building and pendulum will be discussed.

A tall building constructed with curtain walls derives its rigidity primarily from a steel framework. For purposes of analysis such a building can be considered to respond like a tuning fork. Random wind forces can cause building vibration which is concentrated within a relatively narrow bandwidth located about a frequency which corresponds to a relatively fixed period of building vibration.

This random building vibration causes random vibration in the various elevator cables including hoist cable 13 and compensating cable 32 (FIG. 1). Furthermore, the elevator cables can resonate if their natural frequency matches the frequency at which the building is vibrating. This cable vibration is damped very little and it has been estimated to have a Q between 100 and 200. Accordingly, it is theoretically possible for a sustained building vibration having an amplitude of $\pm 1$ inch to cause $\pm 200$ inches of elevator cable sway. It should be noted that buildings have been measured vibrating with an amplitude of $\pm 5$ inches. The above-mentioned resonance of the cables causes a swaying problem which is difficult to solve because the length of the cables 32 and 13 from car 10 and counterweight CW to the sheaves S and CS changes. Thus the natural frequency of the cables 32 and 13 changes as a consequence of car 10 changing position.

As noted previously, the compensating and hoist cables 32, and 13 comprise a plurality of parallel cables which can entangle when they sway. This problem can be exacerbated if the individual cables have different tensions which can result in different kinds of motion for each cable. When the cables 32 and 13 travel at high speeds it is possible for them to enter the sheaves S and CS before they have had time to separate. This condition can cause damage and possibly sever cables 32 and 13. Furthermore, it is theorized that vertical movement of a vibrating cable causes transverse acceleration forces which is a function of the vertical velocity. These forces may further increase the severity of the cable sway. For these reasons it is believed reduced vertical velocity reduces the possibility of tangled cables going through sheaves S and CS.

With these considerations in mind, attention is now focused on the required sensitivity of pendulum P. If pendulum P is designed to protect against a resonating cable whose natural frequency exactly matches the frequency of the vibrating building, it must be sensitive indeed. As a practical matter, however, a lower sensitivity will be satisfactory since it is thought that exact resonance rarely occurs. Furthermore a lower sensitivity avoids operating elevator car 10 at reduced speed unnecessarily. The following describes design procedures for selecting a pendulum sensitivity which was found to operate successfully in the constructed embodiment. It will be appreciated however that each installation is unique and that further adjustment may be required to account for peculiarities of particular elevator installations in different buildings. The operation of the control system of the present invention is tested by observing the severity of cable sway on a windy day and verifying that elevator speed is reduced when swaying is judged to be sufficient to cause damage.

In order to fully describe the response of pendulum P the steady state and transient response will be discussed. The steady state response is discussed first because it is more readily understood and facilitates understanding of the transient response. Also, it will be seen that as a practical matter pendulum P can be designed by considering only the steady state response and that the length of cable 15 primarily determines sensitivity.

Accordingly, for purposes of analysis, pendulum P will be considered to be a true pendulum and consequently will be analyzed as a vibrating second order mechanical system having a negligibly small damping factor in accordance with the well-known equations for harmonic motion. In the preferred embodiment the angular displacement of pendulum P is sufficiently small so that it responds as a linear system.

When a mechanical system is forced to vibrate near its natural frequency, magnification can occur. At steady state the magnification for an undamped linear second order mechanical system is a function of the ratio of the period of the forced vibration to the period at the system's natural frequency. The magnification factor is defined by the following equation which is adapted from the general equation for the magnification factor of a second order mechanical system given in Marks, Mechanical Engineers Handbook, McGraw-Hill 1958, W. T. Thomson — pp. 5–96 to 5–98.

$$M = \frac{1}{1 - \left(\frac{T_p}{T_B}\right)^2} \quad (1)$$

$T_B =$ period of forced vibration, i.e. the period of building vibration
$T_p =$ period of system's natural frequency In adapting the foregoing equation the component identified in Marks as the structural damping coefficient has been ignored. It is apparent that bringing the period at a system's natural frequency nearer to the period of forced vibration increases the magnification. The well-known formula for determining the period of natural frequency for a pendulum, the system under consideration is:

$$T_p = 2\pi\sqrt{\frac{1}{g}} \quad (2)$$

$g =$ acceleration of gravity
$l =$ length of pendulum

The period of vibration of any building should be obtainable from the building specifications or by consulting the building's architect. In any event the period can be measured by placing accelerometers in the upper portion of the building and recording the acceleration in several direction. It is noted that the period can vary with direction. The building in which the disclosed constructed embodiment was installed vibrates in the east-west direction at a period of 7.5 seconds and in the north-south direction at a period of 7.9 seconds. To assure that pendulum P was sufficiently sensitive to building vibration, a magnification factor of at least +5 was judged to be satisfactory. Since a positive magnification is used in the constructed embodiment, inspection of equation (1) will reveal that the pendulum period $T_P$ will be shorter than the natural period of the building $T_B$. It should also be evident that for a given pendulum period the least magnification will occur in response to building vibration having the longest building period.

From the straightforward mathematical application of equations (1) and (2) it will be seen that to obtain a positive magnification factor of 5 for vibration in the direction corresponding to the 7.9 second building period pendulum P should have a length which would provide it with a period of 7.05 seconds. A length of 40.8 feet provides such a period. A period of 7.05 seconds provides a magnification factor of +9 for vibrations in the direction corresponding to the building period of 7.5 seconds.

In accordance with the foregoing, in the constructed embodiment, clamping means 17 was initially attached to a point along counterweight rail 19 to provide pendulum P with a free length of 40.8 feet from that point. After observation it was decided that this length made pendulum P too sensitive and the length was shortened to 38 feet.

The height at which clamping means 17 was attached to rail 19, of course, is determined by the point in the building at which it is desired to sense vibratory motion. In the disclosed embodiment the elevators the invention was employed with had a 47 story rise. The clamping means was attached at about the forty-seventh story.

In the disclosed embodiment the clearance between the weight W and ring 31 (FIG. 2) was approximately 5 inches. Accordingly, if it is assumed that a steady state condition is reached, ±1 inch of building vibration causes weight W to strike bucket B under the assumed condition. If a smaller clearance is used on different embodiments a correspondingly lower magnification factor should be used to obtain comparable results.

The above discussion concentrated on the steady state response of pendulum P. It is appreciated, however, that the magnification of phenomenon produced by pendulum P does not occur instantaneously. Instead, each swing of the building adds energy to pendulum P, causing its amplitude to increase over the course of several periods of building vibration. For example, in the constructed embodiment, 1.5 inches of vibration in the direction corresponding to the 7.9 second period at the top of pendulum P will cause weight W to move in excess of 5 inches after about five oscillations of pendulum P. This means pendulum P will strike the upper edge of bucket B approximately 35 seconds after building vibration commences. Also, it will be apparent that this time delay is shortened if the amplitude of building vibration is greater than 1.5 inches. The dynamics of a pendulum are well understood so that detailed discussion of its transient response will not be presented herein in order to simplify this disclosure. It is noted, however, that pendulums similar to the disclosed pendulum P can be expected to have a transient amplitude of vibration which exceeds the expected steady state response. This overshooting phenomenon, however, does not differ greatly from the steady state response and accordingly the steady state analysis is deemed sufficient for practical purposes in designing pendulums for different buildings.

Assume now that vibration of the building due to wind load causes weight W to strike bucket B (FIG. 1) and produce a vibration signal. This completes an electrical circuit through contacts PS1 of FIG. 3. Also assume that this occurs when elevator car 10 is at rest and in register with a landing.

Upon the closure of contacts PS1, capacitor C1 rapidly discharges and current is drawn through resistor R1, and diode CR1. This discharge continues until the voltage at the junction of resistors R1, R2 is approximately zero volts. As a result the base emitter voltage of transistor Q1 is also approximately zero volts thereby turning it off and preventing current from flowing into its collector. With transistor Q1 off, current flows from line L1 through resistors R3 and R4 into the base of transistor Q2, turning this transistor on. As a result current flows through the emitter collector circuit so that coil RP becomes energized.

Energization of coil RP operates the pendulum slave switch to close contacts RP1 and open contacts RP2. Since contacts RR1 are closed, current passes from line AC through contacts RP1 and RR1 to energize coil LR and close contacts LR2. Upon the closing of contacts LR2 coil LR remains energized so long as contacts RR1 remain closed.

Since the pendulum is vibrating, contacts PS1 are intermittently opened and closed. When contacts PS1 subsequently open coil RP is deenergized. Contacts LR2, however, provide an alternate current path so that coil LR remains energized when contacts RP1 open. Also, when contacts RP2 reclose in this fashion an energizing potential is now supplied to terminal TT of the timer TIM so that after the expiration of a predetermined time interval coil RR will be energized. In the constructed embodiment this time interval was set for a few minutes and for the purposes of the present discussion, it will be assumed that before this period elapses pendulum P again contacts bucket B so that contacts PS1 again close. As a consequence, the energization of coil RR does not occur. Coil LR thereby remains energized and contacts LR1 (FIG. 5) are closed. Since the first speed switch is released, coil SWA is energized through contacts LR1 and 1E3.

Assume now that the car is to commence interfloor movement in an upwardly direction in response to a start signal and that consequently, the movable contact of switch S1 of FIG. 5 moves from terminal P2 to terminal P1 to energize coil U. Upon this occurrence coils GK and XMC are energized, as explained previously. The closing of contacts U7 provides a second circuit path to coil SWA through closed contacts U7 and SWA3. It should be noted that if contacts LR1 open subsequently in response to the timer TIM (FIG. 4) energizing coil RR and deenergizing coil LR, this event will not deenergize coil SWA. Coil SWA will only be deenergized by the opening of contacts U7, which event is described subsequently. Contacts 1E1 through 4E1 are open at this time and as previously described car 10 begins movement with the total resistance of element GFR1 controlling the current through generator field GF.

The operation of the sway control switch closes contacts SWA2 and opens contacts SWA1. These contacts are arranged to effect the current in generator field GF and motor field MF to reduce the maximum obtainable car speed. The closing of contacts SWA2 has no immediate effect since, as previously explained, contacts XMC1 are closed at this time in parallel with the circuit which includes contacts SWA2.

The opening of contacts SWA1 inserts the total resistance element R7 in series with generator field GF since as previously noted the stop control switch is operated at this time and contacts GK3 are open. Therefore, as the car continues to accelerate and contacts 1E1 through 4E1 are sequentially closed, series resistance element R7 continues to limit the current through generator field GF. As a consequence the maximum output of generator armature 12 applied to motor armature M is reduced from what it was during the previously described operation.

As the fourth speed switch is operated to close contacts 4E1, it also opens contacts 4E3. The opening of contacts 4E3 together with open contacts GK4 interrupts the circuit to coil XMC of the motor field switch as previously described. Contrary to the operation previously described, however, the resulting opening of contacts XNC1 does not insert all of resistor MFR in series with motor field MF. Because contacts U3, 1E4 and SWA2 are closed at this time, the portion of resistor MFR between terminal T3 and terminal T4 only is inserted in series with motor field MF. In comparison with the previously described operation under conditions which prevail in the absence of a vibration signal, the production of a vibration signal causes such operation that the opening of contacts XMC1 produces less of a reduction in the current through motor field MF. This feature causes motor M to operate with reduced speed. Therefore, the combined effects of resistance element R7 being inserted into the circuit of generator field GF and contacts 1E4, SWA2 increasing the current in motor field MF is to reduce the maximum speed obtainable by car 10.

As previously described, elevator car 10 continues to operate until switch S2 opens to deenergize coil GK of the stop control switch, signifying the initiation of the stopping operation. The release of the stop control switch causes contacts GK2 to open and contacts GK1 to close, the latter contacts operating to short out resistance element GFR1. As previouly noted the resistance in series with generator field GF increases because the non-shorted section D of element GFR2 presents more resistance than previously presented by non-shorted section A of element GFR1. Accordingly, the shift from element GFR1 to GFR2 by itself decreases the generator field current and decelerates car 10. Since car 10 is operating at a maximum speed which is lower than previously described, it is desirable to reduce the effect of this change in resistance from element GFR1 to element GFR2. Accordingly, this effect is reduced by shorting out a portion of resistor R7. Contacts GK3 are utilized for this purpose so that the net series resistance change presented to generator field GF is reduced.

As previously described the closing of contacts GK4 causes the energization of coil XMC of the motor field switch. This causes contacts XMC1 to close to increase the motor field current and provide another step of deceleration. Because contacts 1E4 and SWA2 are closed at this time, however, the step is not as large as during operation in the absence of the production of a vibration signal. The remainder of the car's deceleration, however, is the same as that previously described.

As the car encounters the landing at which a stop is to be made, the movable contact of switch S1 moves to position P2 to deenergize coil U thus releasing the up direction switch. As a result contacts U7 open so that the self-holding feature provided by contacts SWA3 is interrupted. Accordingly, coil SWA1 is thereafter subject to the control of contacts LR1 and 1E3.

Whether car 10 again operates at a reduced speed depends on whether the sway control switch (coil SWA) is actuated when the car is to start again. The conditions which cause the sway control switch (coil SWA) to remain in the actuated condition are as follows:

As noted previously, timer TIM is arranged to maintain the latched pendulum switch (coil LR) in an actuated condition for a given time period after weight W contacts bucket B. For this reason the sway control switch after being actuated remains actuated for at least this given time period. Also, because each subsequent contact between weight W and bucket B resets timer TIM and initiates another given time interval, the sway control switch remains actuated so long as weight W contacts bucket B before each given time interval expires.

Furthermore, if the sway control switch is in its actuated condition, it will be self-held as soon as car 10 again commences to move. For simplification purposes this feature is disclosed by utilizing contacts of the up and down direction swith (contacts U7 and D7), although it is apparent that other embodiments could use a different arrangement so that the self-holding feature becomes operative only after the car exceeds predetermined velocity and only until a stopping operation is commenced.

It neither timer TIM or contacts U7 and D7 are operating as described above to maintain the sway control switch in its operating condition, it is released. This latter situation occurs when car 10 is at rest and a vibration signal has not been produced for the predetermined interval of timer TIM. It is understood, however, that it is possible to retransfer the sway control switch to its actuated condition whenever the speed control means maintains the first speed switch in a released condition (contacts 1E3 open) so that car 10 is operating at less than a particular speed. If car 10 is so operating the sway control switch will retransfer to its actuated condition in respeonse to the generation of a vibration signal when weight W contacts bucket B to cause the actuation of the latched pendulum switch and the closure of contacts LR1.

While the foregoing describes an operation with a pendulum-like device other mechanical systems can be used to produce a vibration signal in response to vibratory motion of a building. The magnification factor for such mechanical systems can be calculated by persons skilled in the mechanical engineering arts.

It is also understood that smaller magnification factors can be sufficient for elevators which do not serve the highest floors. In the building in which the constructed embodiment was installed it was found that a magnification factor of 2.7 provided sufficient protection for lower rise elevators which do not travel above the 38th floor.

It is contemplated that a building having high, high-intermediate and other lower rise elevators could be serviced by a single pendulum which has a magnification factor of 5. This arrangement will reduce the flexibility of the system, however, since the various elevators cannot be individually adjusted in their response to vibratory motion. Also the savings in utilizing a single pendulum may be offset by additional expense associated with routing electrical signal conductors between the various elevator systems. The use of a single pendulum, however, will be effective to prevent damage to all of the associated elevator cables.

Various other modifications to the foregoing arrangement will be evident to those skilled in the art and for that reason it is intended that the arrangement be considered illustrative only and not limiting in any sense.

What is claimed is:

1. An elevator control system for use in a building which occasionally experiences vibratory motion caused by wind, said elevator control system including a drive motor for moving an elevator through a hostway in said building to any one of a plurality of landings at which it can be stopped and further comprising:

speed control means controlling said motor so that said car can move at a maximum velocity having a first predetermined magnitude;

vibration sensing means responsive to said vibratory motion and producing a vibration signal in response to said vibratory motion of a predetermined magnitude being sustained for a predetermined time interval; and limit means operating in response to said vibration signal and controlling said speed control means to limit the maximum velocity at which said motor can move said car to a second predetermined magnitude which is less than said first predetermined magnitude.

2. An elevator control system according to claim 1, wherein said vibration sensing means comprises:

a support including a clamping means mounted in said hoistway at a height at which said vibratory motion of said perdetermined magnitude occurs;

a weight; and a cable freely suspending said weight from said clamping means, said cable having a free length between said clamping means and said weight such that said weight moves a predetermined distance from an equilibrium position in response to said vibratory motion of said predetermined magnitude being sustained for said predetermined time interval, movement of said weight said predetermined distance operating to produce said vibration signal.

3. An elevator control system according to claim 2, wherein said vibration sensing means comprises:

an electrically conductive annular member vertically aligned with said clamping means and horizontally mounted in said hoistway at a height to encircle said weight which thereby makes contact therewith upon moving said predetermined distance from said equilibrium position;

a source of electrical energy; and circuit means coupling said source of electrical energy to said annular member and said weight whereby an electrical current flow through said circuit means upon said weight contacting said annular member, said electrical current producing said vibration signal.

4. An elevator control system according to claim 3, wherein said vibratory motion has a limited bandwidth located about a frequency corresponding to a predetermined period of said vibratory motion, and wherein said cable has a free length which if possessed by a pendulum would provide it with a period of free vibration which differs from said predetermined period by a predetermined amount.

5. An elevator control system according to claim 4, wherein said clamping means comprises:

an intermediate support means detachably affixed to said building at said height at which said vibratory motion of said predetermined magnitude occurs; and a clamping device for releasably clamping said cable to said intermediate support means;

and wherein said support also includes:

upper support means mounted above said intermediate support means, said upper support means supporting said cable and said weight when said cable is released from said clamping means, said upper support means when so supporting said cable and said weight, providing said cable with a free length which if possessed by a pendulum would provide it with a period of free vibration substantially equal to said predetermined period.

6. An elevator control system according to claim 5, wherein said intermediate support means comprises:

a bracket detachably affixed to said building at said height at which said vibratory motion of said predetermined magnitude occurs;

a first member pivotally suspended from said bracket and pivotable in one of a pair of vertically disposed orthogonal planes; and a second member pivotally suspended from said first member and pivotable in the other of said pair of orthogonal planes, said clamping device releasably clamping said cable to said second member so that angular translation of said cable in a direction having components in each of said pair of orthogonal planes causes angular translation of said first and second members to reduce flexing and abrading of said cable.

7. An elevator control system according to claim 1, wherein said limit means includes:

low speed signifying means transferable from a first to a second state in response to said vibration signal when said motor is moving said car at a velocity less than said second predetermined magnitude, said low speed signifying means when in said second state controlling said speed control means to limit the maximum velocity at which said motor can move said car to said second predetermined magnitude.

8. An elevator control system according to claim 7, wherein said low speed signifying means is transferable from said second to said first state when said motor is moving said car at a velocity less than said second predetermined magnitude.

9. An elevator control system according to claim 8, which includes a source of energizing potential, wherein said low speed signifying means includes:

relay means having a control terminal and being transferrable between an actuated and unactuated condition, said actuated and unactuated conditions corresponding to said second and first states, respectively, of said low speed signifying means, said relay means being in said actuated condition while energizing potential is applied to said control terminal;

first coupling means coupling said source of energizing potential to said control terminal in response to the production of said vibration signal when said motor is moving said car at a velocity less than said second predetermined magnitude; and second coupling means operating in response to said relay means being in said actuated condition and coupling said source of energizing potential to said control terminal as long as said motor is moving said car.

10. An elevator control system according to claim 9, wherein said first coupling means is operable to couple said source of energizing potential to said control terminal only when said motor is moving said car at a velocity less than a third predetermined magnitude which is less than said second predetermined magnitude.

11. An elevator control system according to claim 1, wherein said vibration sensing means includes a stabilizing means operating in response to said vibratory motion of said predetermined magnitude being sustained for said predetermined time interval to continue production of said vibration signal for a given time period after vibratory motion of said building becomes less than said predetermined magnitude.

12. An elevator control system according to claim 1, wherein said speed control means includes a generator having a generator field winding, said generator supplying a variable current to said motor to vary the speed thereof; and a source of generator field potential connected to said generator field winding to supply current to said generator field winding to cause said generator to supply current to said motor thereby to control the speed of said motor; and wherein said limit means includes:

a resistance element; and first switching means operating in response to said vibration signal and connecting said resistance element in series with said source of generator field potential and said generator field winding to limit the current applied thereto and limit the maximum velocity at which said motor can move said car to said second predetermined magnitude.

13. An elevator control system according to claim 12, wherein said motor includes a motor field winding; wherein said speed control means includes a source of motor field potential connected to said motor field winding; and a variable resistance element serially connected with said source of motor field potential and said motor field winding; and wherein said limit means includes:

second switching means connected to said variable resistance element and operating in response to said vibration signal to reduce the effective resistance of said variable resistance connected in series with said motor field winding.

14. A vibration sensing means for use in a building which occasionally experiences vibratory motion caused by wind, comprising:

a weight;

a support including a clamping means mounted in said building at a height at which said vibratory motion of a predetermined magnitude occurs;

a cable clamped to said clamping means and freely suspending said weight from said clamping means, said cable having a free length between said clamping means and said weight such that said weight can move a predetermined distance from an equilibrium position in response to said vibratory motion of said predetermined magnitude being sustained for a predetermined time interval;

an electrically conductive annular member vertically aligned with said clamping means and horizontally mounted on said building at a height to encircle said weight and make contact therewith upon said weight moving said predetermined distance from said equilibrium position;

a source of electrical energy; and circuit means coupling said source of electrical energy to said annular member and said weight whereby an electrical current flows through said circuit means upon said weight contacting said annular member.

15. A vibration sensing means according to claim 14, wherein said vibratory motion has a limited bandwidth located about a frequency corresponding to a predetermined period of said vibratory motion and wherein said cable has a free length which if possessed by a pendulum would provide it with a period of free vibration which differs from said predetermined period by a predetermined amount.

16. A vibration sensing means according to claim 15, wherein said clamping means comprises:

an intermediate support means detachably affixed to said building at said height at which said vibratory motion of said predetermined magnitude occurs;

a clamping device for releasably clamping said cable to said intermediate support means;

and wherein said support also includes:

an upper support means mounted above said intermediate support means, said upper support means supporting said cable and said weight when said cable is released from said clamping means, said upper support means when so supporting said cable and said weight, providing said cable with a free length which if possessed by a pendulum would provide it with a period of free vibration substantially equal to said predetermined period.

17. A vibration sensing means according to claim 16, wherein said intermediate support means comprises:

a bracket detachably affixed to said building at said height at which said vibratory motion of said predetermined magnitude occurs;

A first member pivotally suspended from said bracket and pivotable in one of a pair of orthogonal planes; and a second member pivotally suspended from said first member and pivotable in the other of said pair of vertically disposed orthogonal planes, said clamping device releasably clamping said cable to said second member so that angular translation of said cable in a direction having components in each of said pair of orthogonal planes causes angular translation of said first and second member to reduce flexing and abrading of said cable.

18. An elevator control system for use in a building which occasionally experiences vibratory motion caused by wind, said vibratory motion having a limited bandwidth centered at a frequency corresponding to a predetermined period of said vibratory motion, said elevator control system including a drive motor for moving an elevator through a hoistway in said building to any one of a plurality of landings at which it can be stopped, said elevator control system also including a source of energizing potential and further comprising:

speed control means controlling said motor so that said car can move at a maximum velocity having a first predetermined magnitude;

a bracket detachably affixed to said building at said height at which said vibratory motion of a predetermined magnitude occurs;

a first member pivotally suspended from said bracket and pivotable in one of a pair of orthogonal planes;

a second member pivotally suspended from said first member and pivotable in the other of said pair of vertically disposed orthogonal planes;

a cable;

a clamping device for relasably clamping said cable to said second member so that angular translation of said cable in a direction having components in each of said pair of orthogonal planes causes angular translation of said first and second members to reduce flexing and abrading of said cable;

a weight freely suspended from said second member by said cable to provide said cable with a free length between said second member and said weight such that said weight can move a predetermined distance from an equilibrium position in response to said vibratory motion of a predetermined magnitude being sustained for a predetermined time interval;

an upper support means mounted above said bracket, said upper support means supporting said cable and said weight when said cable is released from said clamping device, said upper support means when so supporting said cable and said weight, providing said cable with a free length which if possessed by a pendulum would provide it with a period of free vibration substantially equal to said predetermined period;

an electrically conductive annular member vertically aligned with said second member and horizontally mounted on said building at a height to encircle said weight and make contact therewith upon said weight moving said predetermined distance from said equilibrium position;

a source of electrical energy;

circuit means coupling said source of electrical energy to said annular member and said weight whereby an electrical current flow through said circuit means upon said weight contacting said annular member, said electrical current operating to produce a vibration signal;

relay means having a control terminal and being transferrable between an actuated and unactuated condition, said relay means in said actuated condition controlling said speed control means to limit the maximum velocity at which said motor moves said car to a second predetermined magnitude which is less than said first predetermined magnitude, said relay means being in said actuated condition while energizing potential is applied to said control terminal;

first coupling means coupling said source of energizing potential to said control terminal in response to the production of said vibration signal when said motor is moving said car at a velocity less than a third predetermined magnitude; and second coupling means operating in response to said relay means being in said actuated condition and coupling said source of energizing potential to said control terminal as long as said motor is moving said car.

* * * * *

UNITED STATES PATENT OFFICE

CERTIFICATE OF CORRECTION

PATENT NO. : 4,056,169

DATED : November 1, 1977

INVENTOR(S) : John Melville Showalter

It is certified that error appears in the above-identified patent and that said Letters Patent are hereby corrected as shown below:

| | | |
|---|---|---|
| Title Page, Left Column: | | After "Assignee" - "United Technologies Corporation, Hartford, Conn." should be --Otis Elevator Company, New York, N.Y.--. |
| Col. 8, line 50 | : | "suppied" should be --supplied--. |
| Col. 8, line 51 | : | "nd" should be --and--. |
| Col. 14, line 50 | : | "XNCl" should be --XMCl--. |
| Col. 15, line 55 | : | "swith" should be --switch--. |
| Col. 15, line 61 | : | "It" should be --If--. |

UNITED STATES PATENT OFFICE

CERTIFICATE OF CORRECTION

PATENT NO. : 4,056,169

DATED : November 1, 1977

INVENTOR(S) : John Melville Showalter

It is certified that error appears in the above-identified patent and that said Letters Patent are hereby corrected as shown below:

Cl. 2, Col. 16, line 63 : "perdetermined" should be --predetermined--.

Cl. 18, Col. 20, line 33: "relasably" should be --releasably--.

Cl. 18, Col. 20, Line 65: "flow" should be --flows--.

Signed and Sealed this

*Twenty-eighth* Day of *March 1978*

[SEAL]

*Attest:*

RUTH C. MASON
*Attesting Officer*

LUTRELLE F. PARKER
*Acting Commissioner of Patents and Trademarks*